US011572258B2

(12) United States Patent
Tao et al.

(10) Patent No.: US 11,572,258 B2
(45) Date of Patent: Feb. 7, 2023

(54) STEEL WIRE SELF-LOCKING MECHANISM AND LIFTING DEVICE

(71) Applicant: JIANGSU JELT LIFTING SYSTEM CO., LTD., Changzhou (CN)

(72) Inventors: Shengrong Tao, Changzhou (CN); Xiaogang Li, Changzhou (CN)

(73) Assignee: JIANGSU JELT LIFTING SYSTEM CO., LTD., Changzhou (CN)

( * ) Notice: Subject to any disclaimer, the term of this patent is extended or adjusted under 35 U.S.C. 154(b) by 5 days.

(21) Appl. No.: 17/331,672

(22) Filed: May 27, 2021

(65) Prior Publication Data

US 2022/0081265 A1 Mar. 17, 2022

(30) Foreign Application Priority Data

Sep. 15, 2020 (CN) ..... 202010964945.0

(51) Int. Cl.
*B66D 1/22* (2006.01)
*B66F 7/28* (2006.01)

(52) U.S. Cl.
CPC . *B66D 1/22* (2013.01); *B66F 7/28* (2013.01)

(58) Field of Classification Search
CPC ... B66D 3/08; B66D 1/60; B66D 1/42; B66D 1/36; B66F 2700/025; B66F 2700/02; B66F 1/08; B66F 1/06; B66F 1/04; B66F 1/025; B66F 1/02; B66F 1/00
See application file for complete search history.

(56) References Cited

U.S. PATENT DOCUMENTS

2008/0041661 A1* 2/2008 Meillet ..... A62B 35/0056 182/13
2008/0061277 A1* 3/2008 Grapes ..... B66D 1/36 254/352
2020/0329862 A1* 10/2020 Tao ..... A47B 9/12

* cited by examiner

*Primary Examiner* — Lee D Wilson
*Assistant Examiner* — Abbie E Quann
(74) *Attorney, Agent, or Firm* — Bayramoglu Law Offices LLC

(57) ABSTRACT

A steel wire self-locking mechanism and a lifting device are provided. The steel wire self-locking mechanism includes a surrounding plate and a self-locking gear and a locking device arranged in the surrounding plate, and uses a friction force of a threaded sleeve to lock the lifting device. The lifting device includes a lifting assembly and a beam assembly. The steel wire self-locking mechanism is arranged in the beam assembly, and the locking of the lifting device is realized by the steel wire self-locking mechanism. The steel wire self-locking mechanism and the lifting device have good adaptability. Due to a smaller volume, the steel wire self-locking mechanism is applicable to lifting tables in various sizes.

18 Claims, 10 Drawing Sheets

STEEL WIRE SELF-LOCKING MECHANISM AND LIFTING DEVICE

CROSS REFERENCE TO THE RELATED APPLICATIONS

This application is based upon and claims priority to Chinese Patent Application No. 202010964945.0, filed on Sep. 15, 2020, the entire contents of which are incorporated herein by reference.

TECHNICAL FIELD

The present invention relates to the field of lifting table devices, and particularly relates to a steel wire self-locking mechanism and a lifting device.

BACKGROUND

An automatic lifting table generally takes electricity as a power source. A mechanical device is controlled by a motor to adjust the height of the lifting table. Alternatively, a pneumatic bar or a hydraulic bar may be controlled by a compressor to adjust the height of the lifting table.

A traditional lifting table usually uses double lifting gas springs to realize a lifting function, which mainly has the following defects: 1) The synchronism is poor: since a gas spring is installed within each of table legs, and the stretching rates of the gas springs are not exactly the same, a lifting process of the lifting table is prone to jam and unsmooth. 2) The adaptability is poor: an adjusting mechanism or a locking mechanism is usually arranged under a table top of a common lifting table to maintain the lifting height, and traditionally, a gas spring is arranged, but it has a large volume and is long, which results that the final stroke of each of the table legs is short, and a small lifting table cannot be manufactured. 3) The economic benefits are poor: since the traditional lifting table uses at least two gas springs as a power source for its lifting power or locking power, more materials are needed. 4) Since the gas springs themselves stretch faster, after the lifting table is unlocked, if a load is separated from the table top, the gas springs will push the table top to move up rapidly, which will generate huge impact and noise under the action of inertia, and will damage the lifting table in severe cases. The height of an existing pneumatic lifting table on the market is locked by gas springs themselves, which are complicated in structure and high in cost. After standing, when the gas springs are used for the first time, there will be defects such as large starting force, delayed starting time and large elastic ratio, so that the comfort of use of the lifting table is affected, the pressing force is large, and the user experience is reduced.

SUMMARY

The technical problem to be solved by the present invention is to provide a steel wire self-locking mechanism and a lifting device with good synchronism, good adaptability and high economic benefits.

In order to solve the above technical problem, the technical solution adopted by the present invention is as follows:

A steel wire self-locking mechanism is provided with surrounding plates including a bottom plate and a first side plate and a second side plate vertically arranged on two long edges of the bottom plate. The steel wire self-locking mechanism includes: a first rotating shaft erected between the first side plate and the second side plate. A threaded sleeve on which a steel wire is wound is arranged outside the first rotating shaft, rotating around the shaft or synchronously rotating with the first rotating shaft.

Further, a self-locking gear rotating with the threaded sleeve is coaxially fixed at one end of the threaded sleeve. A locking device for locking the self-locking gear is also arranged between the first side plate and the second side plate. A dragline hole is formed in the first side plate. A dragline passes through the dragline hole and drives the locking device to open and close. The dragline is driven by an external dragline handle.

Further, the locking device includes an L-shaped plate fixed to the bottom plate. A fixing shaft is arranged between the L-shaped plate and the first side plate. The fixing shaft is sleeved with a first locking plate and a torsion spring. A tail end of an outer side of the torsion spring is folded toward the direction of the first locking plate and extends. The first locking plate includes a plate body. A tooth part is arranged on a surface where a tail end of the plate body is attached to the self-locking gear. A pull plate is arranged at a middle part of the plate body. A hook part is arranged at an upper end of the pull plate. A hook groove is formed in the hook part. A pull block passes through the hook groove and is fixedly connected with the dragline.

Further, the locking device includes a second locking plate, a convex plate and a tension spring. At least two slotted holes are formed in a middle of the second locking plate. Fixing shafts matched with the slotted holes are arranged on the first side plate. One end of the second locking plate close to the self-locking gear is provided with a tooth part, and the other end of the second locking plate is provided with a hook part. A hook groove is formed in the hook part. A pull block passes through the hook groove and is fixedly connected with the dragline. A tension spring hole is formed in a bottom of the hook part. One end of the convex plate is fixed to the first side plate, and the other end of the convex plate protrudes toward the direction of the second side plate. One end of the convex plate that protrudes is connected with the tension spring hole through the tension spring.

Further, a motor is arranged at one end of the threaded sleeve. An output end of the motor is fixedly connected with the first rotating shaft or the threaded sleeve. The motor is powered by an external power supply. The motor is controlled by an external electric control handle to rotate forward, rotate backward and stop.

The present invention also discloses a lifting device with a steel wire self-locking mechanism, including the above-mentioned steel wire self-locking mechanism, and further including two lifting assemblies arranged in a manner of central symmetry. A beam assembly is erected between the lifting assemblies. A first steel cable and a second steel cable parallel to each other are arranged between the lifting assemblies. A middle part of the first steel cable is wound on a threaded sleeve. Two ends of a part of the first steel cable wound on the threaded sleeve are located on a same horizontal line. The lifting assemblies include an outer fixing pipe and an inner fixing pipe. A gas spring is arranged in the inner fixing pipe. A top end of the outer fixing pipe is fixedly connected with a bottom end of the beam assembly. A lifting end of the gas spring is connected with a pin shaft. The pin shaft radially passes through the beam assembly and is fixed with the beam assembly.

Further, a first retainer and a second retainer are arranged between the outer fixing pipe and the inner fixing pipe. The first retainer and the second retainer are coated on the inner fixing pipe at an interval. Surfaces of the first retainer and the second retainer are provided with at least four ring grooves. Balls are arranged in the ring grooves.

Further, a U-shaped connecting rod is also arranged in the inner fixing pipe. The U-shaped connecting rod includes a connecting rod body. The upper and lower sections of the connecting rod body are respectively provided with a first pulley and a second pulley. The first pulley sleeves the pin shaft. The pin shaft is also sleeved with a third pulley. The first pulley and the third pulley are respectively arranged at two sides of the gas spring.

A first fixing component is arranged on a side wall of the inner fixing pipe close to the outside, and a second fixing component is arranged on a side wall of the inner fixing pipe close to the inside.

One end of the first steel cable is wound on the first pulley and the second pulley on one side and is fixed to the second fixing component, and the other end of the first steel cable is wound on the third pulley on the other side and is fixed to the first fixing component. The two ends of the second steel cable are arranged in the same manner as the two ends of the first steel cable, but in opposite directions.

Further, the beam assembly includes a first bracket and a second bracket oppositely arranged at the top end of the outer fixing pipe. The bottom ends of the first bracket and the second bracket are provided with holes, allowing the lifting end of the gas spring to pass through. A beam frame is arranged between the first bracket and the second bracket. Two ends of the beam frame are respectively provided with a first through hole and at least one second through hole. The first through hole is formed on the inner side of the second through hole. When folding, the first bracket and the second bracket are rotatably connected with the beam frame only by the first through hole; and when unfolding, the first bracket and the second bracket are fixedly connected with the beam frame by the first through hole and the second through hole. The beam frame is fixedly connected with the bottom plate.

Further, a length of the first bracket is greater than a length of the second bracket by a width distance of at least one outer fixing pipe.

In summary, compared with the traditional technical means, the technical solution of the present invention has the following beneficial effects:

1. The present invention has good synchronism. Two steel cables which synchronously move in parallel are used to pull the outer fixing pipe to move up and down so as to drive the lifting device to move, and thus, a jamming phenomenon in a lifting process can be effectively reduced.

2. The present invention has good adaptability. Due to a smaller volume, the steel wire self-locking mechanism of the present invention can adapt to lifting tables in various sizes.

3. The present invention has good economic benefits. Since only one gas spring is used in the present invention, compared with other lifting tables, the cost of the present invention is significantly reduced.

4. A damping device is arranged in the gas spring of the present invention. When the gas spring is extended to the final stage, the gas spring will automatically decelerate to prevent the lifting device from being damaged. Due to a small elastic ratio, the gas spring can be easily pressed down. After standing, when the gas spring is used for the first time, both the starting force and the starting delay are effectively improved, and the gas spring can be opened at one time.

BRIEF DESCRIPTION OF THE DRAWINGS

To describe the technical solutions of the embodiments of the present invention more clearly, the following briefly introduces the accompanying drawings required for describing the embodiments. It should be understood that the accompanying drawings in the following description show only some embodiments of the present invention and do not constitute a limitation to the scope, and those of ordinary skill in the art may still derive other related accompanying drawings from these accompanying drawings without creative efforts.

LIST OF REFERENCE NUMERALS

Figure 1:
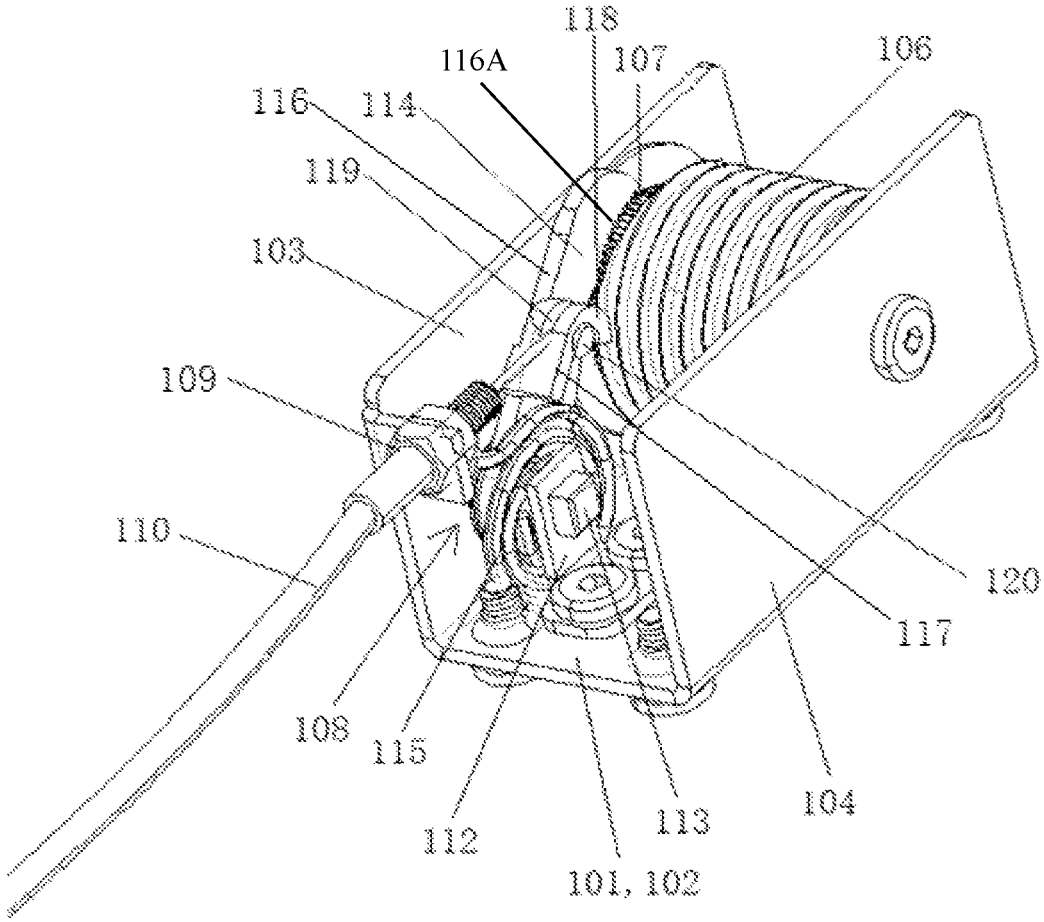
FIG. 1 is a schematic structural diagram of a steel wire self-locking mechanism according to Embodiment 1 of the present invention.
Figure 2:
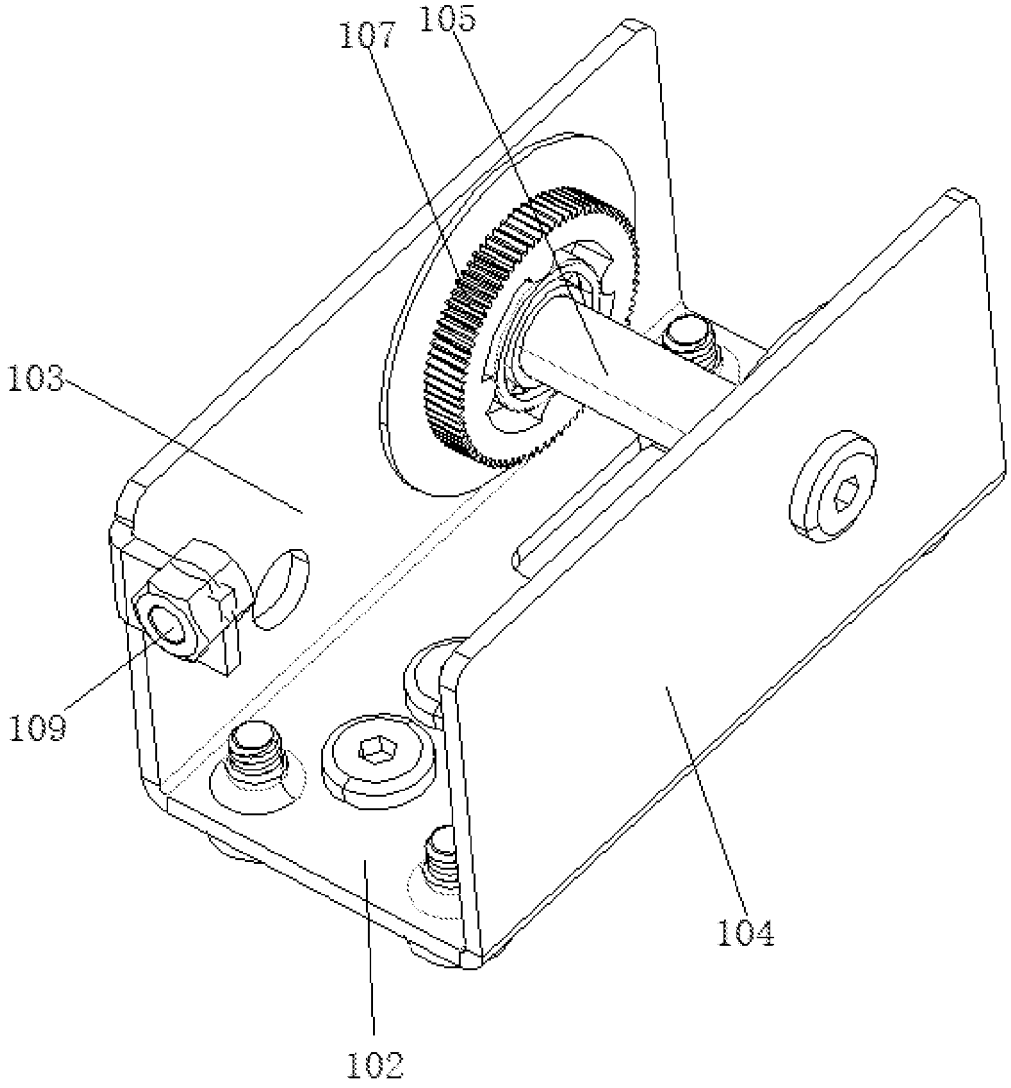
FIG. 2 is a schematic structural diagram after a threaded sleeve and a locking device in FIG. 1 are hidden.
Figure 3:
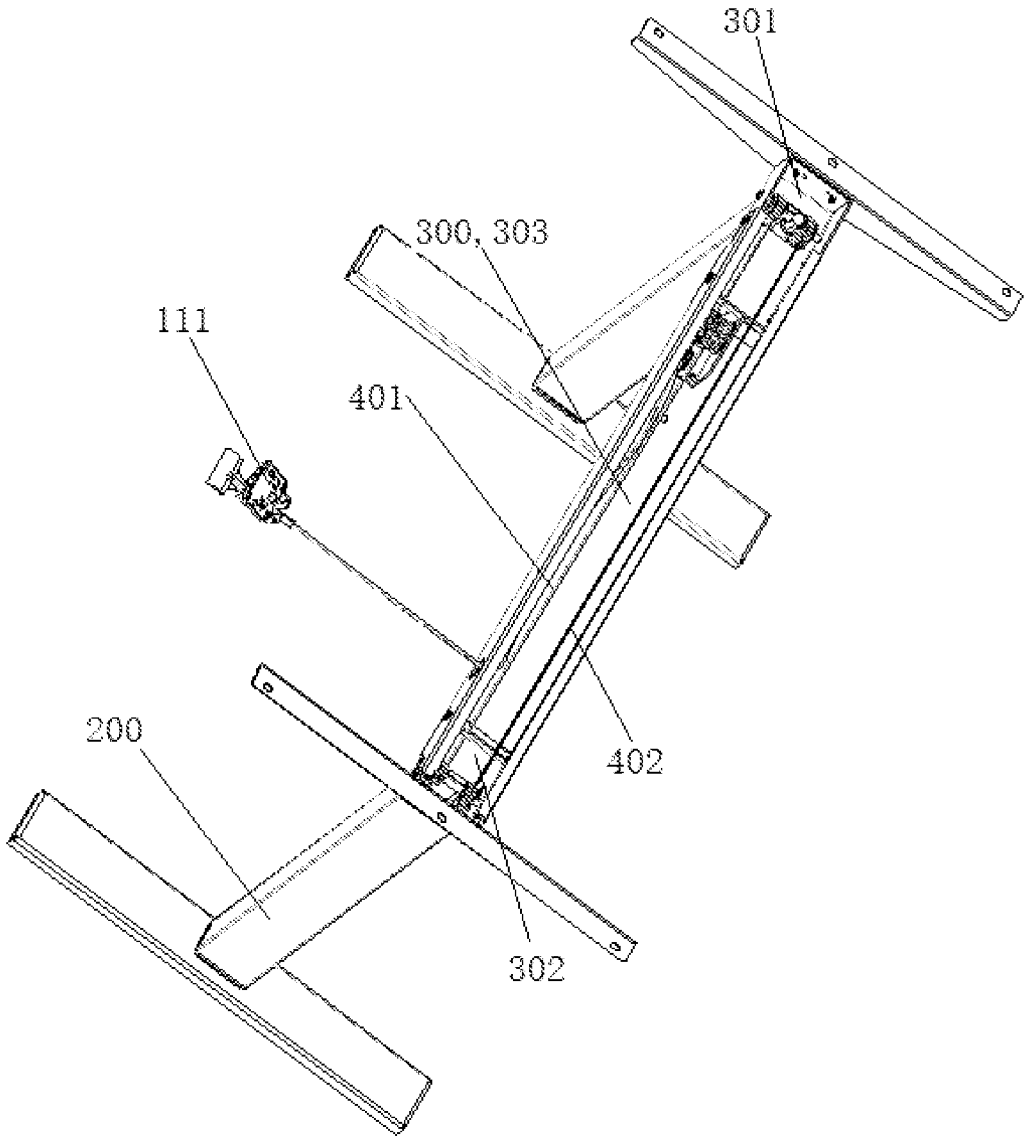
FIG. 3 is a schematic diagram of a three-dimensional structure of a lifting device of the present invention.
Figure 4:
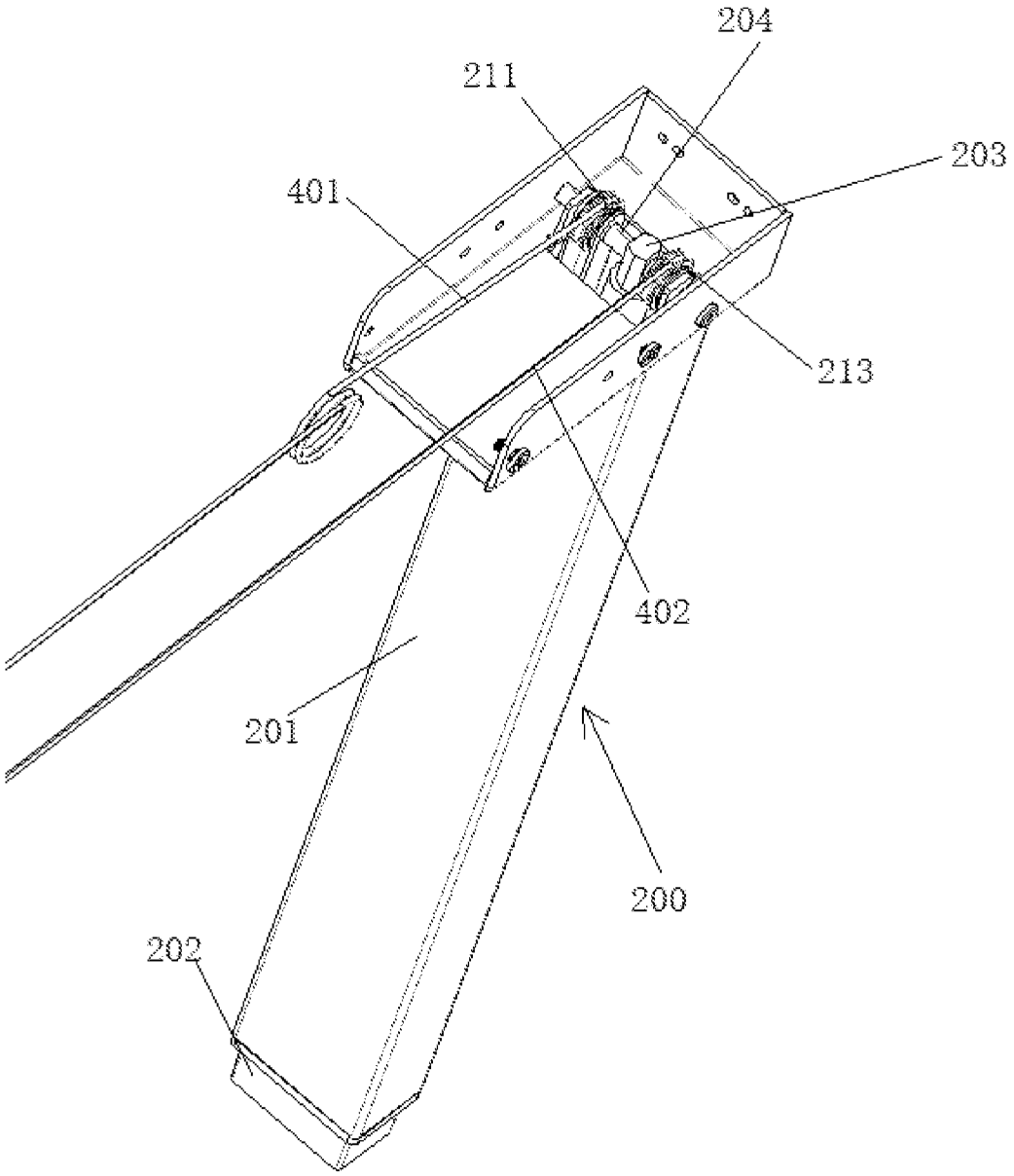
FIG. 4 is a schematic diagram of a three-dimensional structure of a lifting assembly of the present invention.
Figure 5:
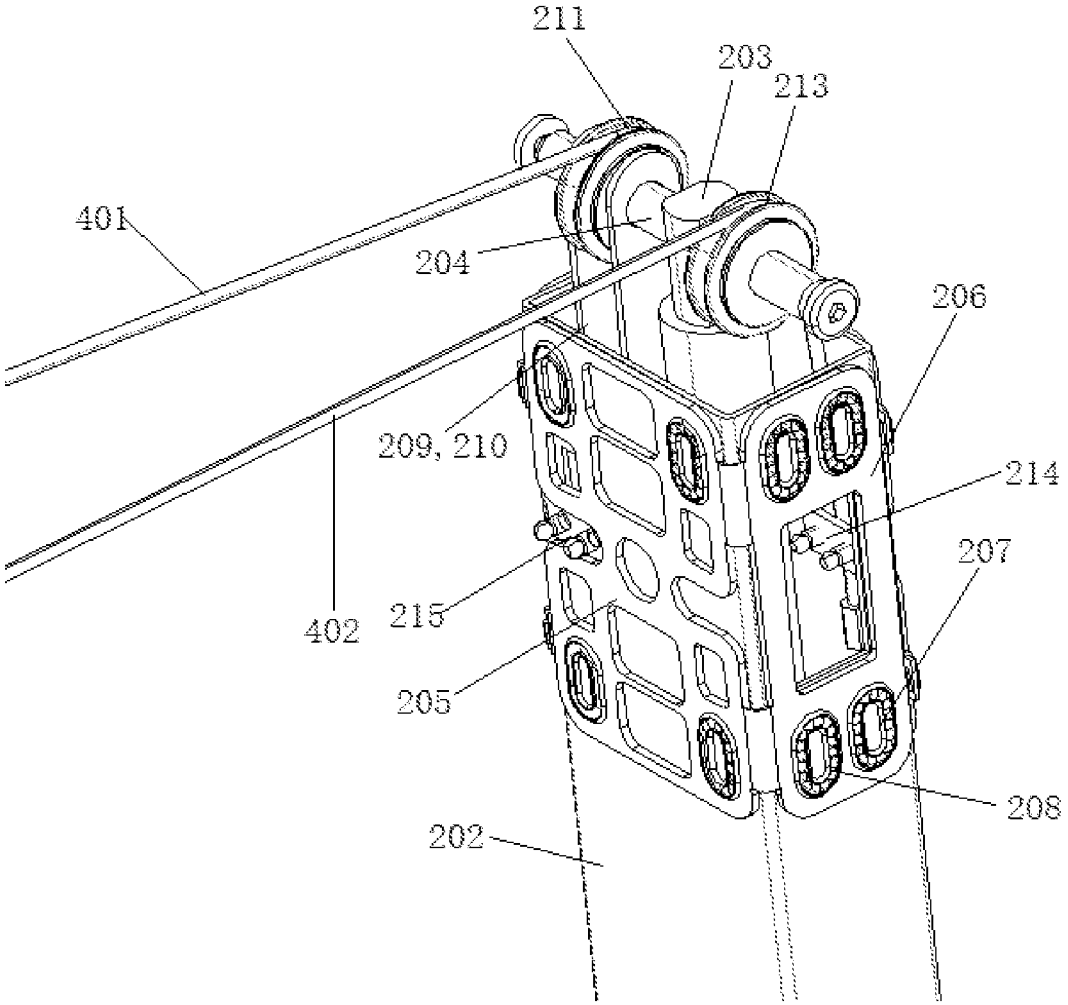
FIG. 5 is a schematic structural diagram after an outer fixing pipe in FIG. 4 is hidden.

101 denotes surrounding plate; 102 denotes bottom plate; 103 denotes first side plate; 104 denotes second side plate; 105 denotes first rotating shaft; 106 denotes threaded sleeve; 107 denotes self-locking gear; 108 denotes locking device; 109 denotes dragline hole; 110 denotes dragline; 111 denotes dragline handle; 112 denotes L-shaped plate; 113 denotes fixing shaft; 114 denotes first locking plate; 115 denotes torsion spring; 116 denotes plate body; 117 denotes pull plate; 118 denotes hook part; 119 denotes hook groove; 120 denotes pull block; 121 denotes second locking plate; 122 denotes convex plate; 123 denotes tension spring; 124 denotes slotted hole; 125 denotes fixing shaft; 126 denotes tension spring hole; 127 denotes motor;

200 denotes lifting assembly; 201 denotes outer fixing pipe; 202 denotes inner fixing pipe; 203 denotes gas spring; 204 denotes pin shaft; 205 denotes first retainer; 206 denotes second retainer; 207 denotes ring groove; 208 denotes ball; 209 denotes U-shaped connecting rod; 210 denotes connecting rod body; 211 denotes first pulley; 212 denotes second pulley; 213 denotes third pulley; 214 denotes first fixing component; 215 denotes second fixing component; 216 denotes cylinder barrel; 217 denotes piston rod; 218 denotes pressure stabilizing piston; 219 denotes flow hole; 220 denotes first cavity; 221 denotes lubricating oil;

300 denotes beam assembly; 301 denotes first bracket; 302 denotes second bracket; 303 denotes beam frame; 304 denotes first through hole; 305 denotes second through hole;

401 denotes first steel cable; 402 denotes second steel cable.

DETAILED DESCRIPTION OF THE EMBODIMENTS

In order to make objectives, technical solutions and advantages of the embodiments of the present invention clearer, the technical solutions in the embodiments of the present invention are clearly and completely described below in conjunction with the accompanying drawings in the embodiments of the present invention, and it is apparent that the described embodiments are parts of embodiments rather than all embodiments of the present invention. Generally, components in the embodiments of the present invention, described and shown in the accompanying drawings, may be arranged and designed in various different configurations.

Therefore, the following detailed descriptions of the embodiments of the present invention, provided in the accompanying drawings, are not intended to limit the scope required to be protected by the present invention, but are only intended to show selected embodiments of the present invention. All other embodiments obtained by a person of ordinary skill in the art based on the embodiments of the present invention without creative efforts shall fall within the protection scope of the present invention.

The present invention will be further explained with reference to the following drawings:

Embodiment 1

A steel wire self-locking mechanism is provided with surrounding plates 101, and the surrounding plates 101 includes a bottom plate 102 and a first side plate 103 and a second side plate 104 vertically arranged on two long edges of the bottom plate 102. A first rotating shaft 105 capable of freely rotating is erected between the first side plate 103 and the second side plate 104. A threaded sleeve 106 is fixedly arranged outside the first rotating shaft 105. A self-locking gear 107 rotating with the threaded sleeve 106 is coaxially fixed at one end of the threaded sleeve 106. A locking device 108 for locking the self-locking gear 107 is also arranged between the first side plate 103 and the second side plate 104. A dragline hole 109 is formed in the first side plate 103. A dragline 110 passes through the dragline hole 109 and drives the locking device 108 to open and close. The dragline 110 is driven by an external dragline handle 111.

In the above-mentioned steel wire self-locking mechanism, the first side plate 103 and the second side plate 104 are vertically arranged on the two long edges of the bottom plate 102 and form an enclosed space. The first rotating shaft 105 is inserted in the positions close to the rear sides of the first side plate 103 and the second side plate 104, and is fixed between the first side plate 103 and the second side plate 104 by hexagon socket head cap screws, thereby providing a basis for installation of the threaded sleeve 106. The surface of the self-locking gear 107 coaxially arranged with the threaded sleeve 106 is provided with an arc-shaped hole. The threaded sleeve 106 is provided with a protrusion on the attached surface, and the protrusion and the arc-shaped hole are in interference fit to prevent the self-locking gear 107 from falling off, and ensure the consistency of the threaded sleeve 106 and the self-locking gear 107 during rotating.

The dragline hole 109 is formed in a side edge of the first side plate 103. Specifically, the first side plate 103 is vertically provided with a plate of the dragline 110 toward the second side plate 104. The plate of the dragline 110 may be welded or integrally formed or fixed at the edge of the first side plate 103 in various other fixed connection manners. The plate of the dragline 110 is provided with the dragline hole 109, and the dragline 110 is accommodated in the dragline hole 109. The dragline 110 actually includes a hexagon bolt matched with the dragline hole 109. A sleeve is arranged in the bolt. A steel string is arranged in the sleeve. The steel string is finally connected with the locking device 108. The steel string is driven by an external dragline handle 111. When the dragline handle 111 is pulled, the steel string retracts to drive the locking device 108 to be unlocked; otherwise, the steel wire expands to make the locking device 108 locked again.

The locking device 108 includes an L-shaped plate 112 fixed to the bottom plate 102 by hexagon socket head cap screws. A fixing shaft 113 is arranged between the L-shaped plate 112 and the first side plate 103. The fixing shaft 113 is sleeved with a first locking plate 114 and a torsion spring 115. A tail end of an outer side of the torsion spring 115 is folded toward a direction of the first locking plate 114 and extends. The first locking plate 114 includes a plate body 116. A tooth part 116A is arranged on a surface where a tail end of the plate body 116 is attached to the self-locking gear 107. A pull plate 117 is arranged at a middle part of the plate body 116. A hook part 118 is arranged at an upper end of the pull plate 117. A hook groove 119 is formed in the hook part 118. A pull block 120 passes through the hook groove 119 and is fixedly connected with the dragline 110.

Specifically, the L-shaped plate 112 includes a horizontal plate and a vertical plate which are integrally formed. The horizontal plate is fixedly connected with the bottom plate 102 by screws. The vertical plate is perpendicular to the horizontal plate. A hole is formed in the vertical plate and can allow the fixing shaft 113 to pass through, and the fixing shaft is fixed to the vertical plate by a cap. One end of the fixing shaft 113 is circular, and the other end of the fixing shaft is square. The hole formed in the vertical plate is a square hole or a flat hole to limit the rotation of the fixing shaft. An inner hole of the torsion spring is in a square shape or another non-rotatable shape, which matches the shape of the square end of the fixing shaft to fix the torsion spring.

The torsion spring 115 has a coiled and elastic metal structure, and an end of the coiled center thereof is parallel to the side surface of the fixing shaft 113. When the torsion spring 115 rotates, the end of the center abuts against the fixing shaft 113 to prevent the fixing shaft from rotating. The tail end of the outer edge of the torsion spring 115 is folded toward the pull plate 117. When the pull plate 117 rotates, the torsion spring 115 is forced to deform. After the external force of the dragline 110 is removed, the torsion spring 115 returns to the original shape so that the locking device 108 is locked again.

On the basis of the above-mentioned steel wire self-locking mechanism, the present invention also provides a lifting device with the steel wire self-locking mechanism. The device further includes two lifting assemblies 200 arranged in a manner of a mirror image. A beam assembly 300 is erected between the lifting assemblies 200. A first steel cable 401 and a second steel cable 402 parallel to each other are arranged between the lifting assemblies 200. A middle part of the first steel cable 401 is wound on a threaded sleeve 106. Two ends of a part of the first steel cable wound on the threaded sleeve are located on a same horizontal line. The lifting assemblies 200 include an outer fixing pipe 201 and an inner fixing pipe 202. A gas spring 203 is arranged in the inner fixing pipe 202. A top end of the outer fixing pipe 201 is fixedly connected with a bottom end of the beam assembly 300. A lifting end of the gas spring 203 is connected with a pin shaft 204. The pin shaft 204 radially passes through the beam assembly 300 and is fixed with the beam assembly by hexagon socket head cap screws.

Specifically, the two lifting assemblies 200 are arranged in a manner of a mirror image, that is, each component in the two lifting assemblies is of central symmetry left and right.

Column feet are also arranged at the bottoms of the lifting assemblies 200 to facilitate the support of the lifting assemblies 200, so that the lifting assemblies cannot tip over.

The above-mentioned steel wire self-locking mechanism is arranged in the beam assembly 300. The first steel cable 401 is wound on the threaded sleeve 106 of the self-locking mechanism by at least two circles, and the first steel cable 401 moves on the threaded sleeve 106 along a thread arrangement direction of the threaded sleeve 106.

Compared with the traditional way of arranging the gas spring 203 in the beam assembly 300, the length of the beam assembly 300 is no longer limited by the length of the gas spring 203, so that a lifting device with a small size can be manufactured, and the cost can be further saved.

A first retainer 205 and a second retainer 206 are arranged between the outer fixing pipe 201 and the inner fixing pipe 202. The first retainer and the second retainer are coated on the inner fixing pipe 202 at an interval. Surfaces of the first retainer and the second retainer are provided with at least four ring grooves 207. Balls 208 are arranged in the ring grooves 207.

Specifically, the inner fixing pipe 202 and the outer fixing pipe 201 are cylindrical, and the cross sections thereof may be in various shapes. Two long surfaces of the inner fixing pipe 202 are coated with the first retainer 205, and two short surfaces of the inner fixing pipe are coated with the second retainer 206. The surfaces of the first retainer and the second retainer are provided with at least four two-by-two symmetrical ring grooves 207, and balls 208 are arranged in the ring grooves 207. By adopting such an arrangement manner, when the inner fixing pipe 202 and the outer fixing pipe 201 move relative to each other, "dry friction" is not easily generated, thus avoiding the damage to the inner fixing pipe 202 or the outer fixing pipe 201.

A U-shaped connecting rod 209 is also arranged in the inner fixing pipe 202. The U-shaped connecting rod 209 includes a connecting rod body 210. The upper and lower sections of the connecting rod body 210 are respectively provided with a first pulley and a second pulley. The first pulley 211 sleeves the pin shaft 204. The pin shaft 204 is also sleeved with a third pulley 213. The first pulley and the third pulley are respectively arranged at two sides of the gas spring 203. Certainly, if the space permits, gas springs can also be arranged on two sides of a pulley.

A first fixing component 214 is arranged on the side wall of the inner fixing pipe 202 close to the outside, and a second fixing component 215 is arranged on the side wall of the inner fixing pipe close to the inside.

One end of the first steel cable 401 is wound on the first pulley 211 and the second pulley 212 on one side and is fixed to the second fixing component 215, and the other end of the first steel cable is wound on the third pulley 213 on the other side and is fixed to the first fixing component 214. The two ends of the second steel cable 402 are arranged in the same manner as the two ends of the first steel cable 401, but in opposite directions.

In the above-mentioned inner fixing pipe 202, both the top end and the bottom end of the U-shaped connecting rod 209 are provided with pulleys. Specifically, both the top end and the bottom end of the U-shaped connecting rod 209 are provided with avoiding holes. A pin shaft 204 is horizontally erected in the avoiding holes, and the connecting rod body 210 is provided with first and second pulleys capable of rotating freely. Meanwhile, the pin shaft 204 is also provided with an independent third pulley 213. The pin shaft 204 itself does not rotate, so the middle position of the pin shaft 204 should be fixedly connected with the bottom of the gas spring 203. The gas spring 203 extends and retracts to drive the pin shaft 204 to move up and down.

The first fixing component 214 is arranged on the side wall of the inner fixing pipe 202 close to the outside, and the second fixing component 215 is arranged on the side wall of the inner fixing pipe close to the inside. It should be understood that this is only a manner of arranging one of the two lifting assemblies 200, and the first and second fixing components in the other lifting assembly 200 should be arranged in a manner of a mirror image, rather than corresponding to the same position.

The above-mentioned first and second fixing components include a fixing piece for clamping the first and second steel cables, and the fixing piece passes through the side wall of the inner fixing pipe 202 by pulling rivets to be fixed with the inner fixing pipe, thereby fixing the tail ends of the first and second steel cables.

Figure 6:
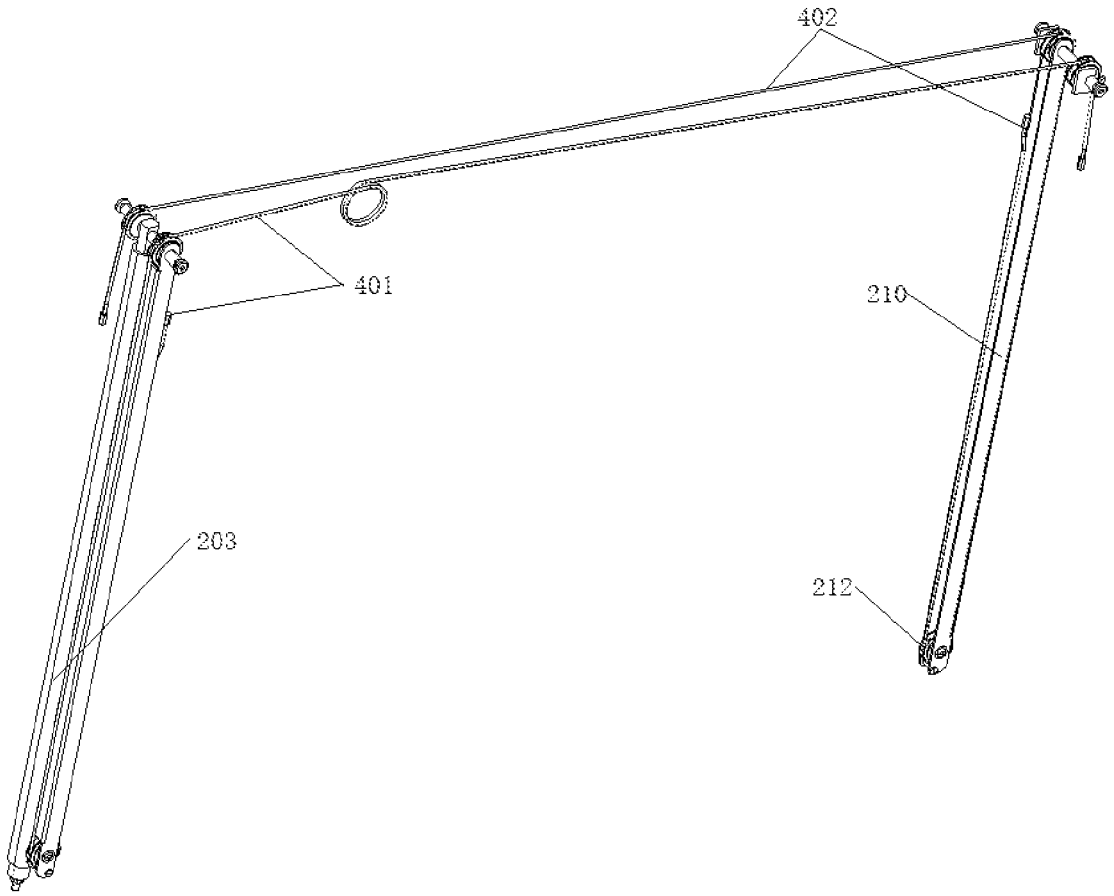
FIG. 6 is a schematic diagram of winding of a first steel cable and a second steel cable of the present invention.
Figure 7:
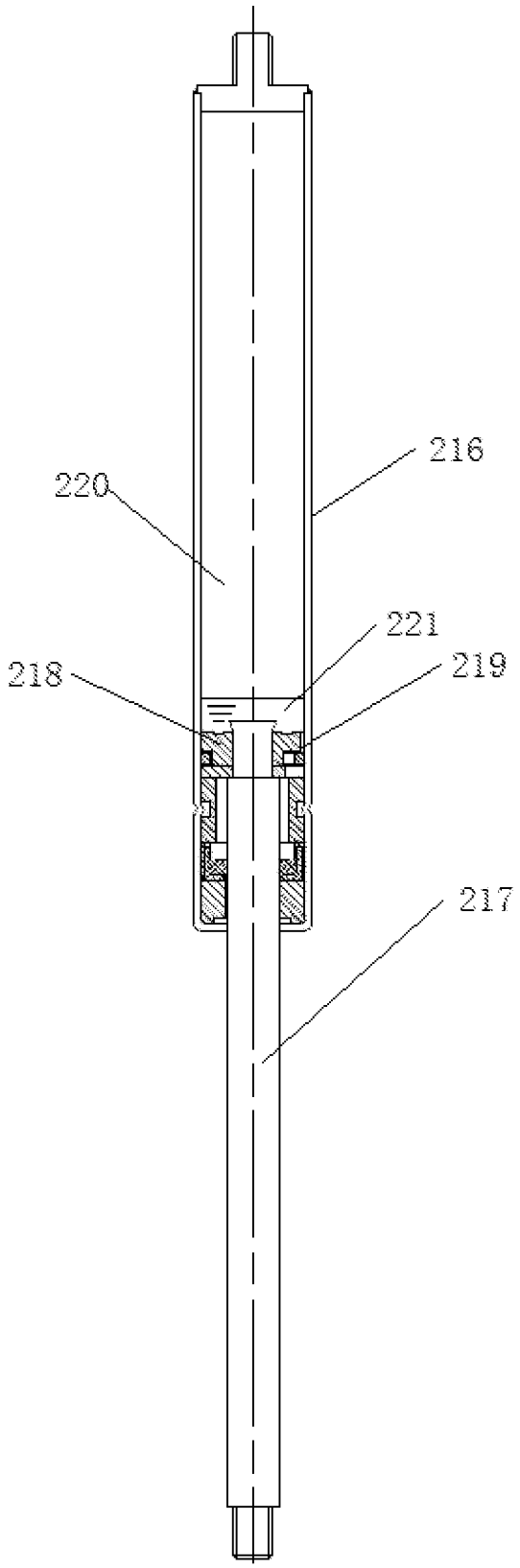
FIG. 7 is a schematic diagram of a cross-sectional structure of a gas spring of the present invention.
Figure 8:
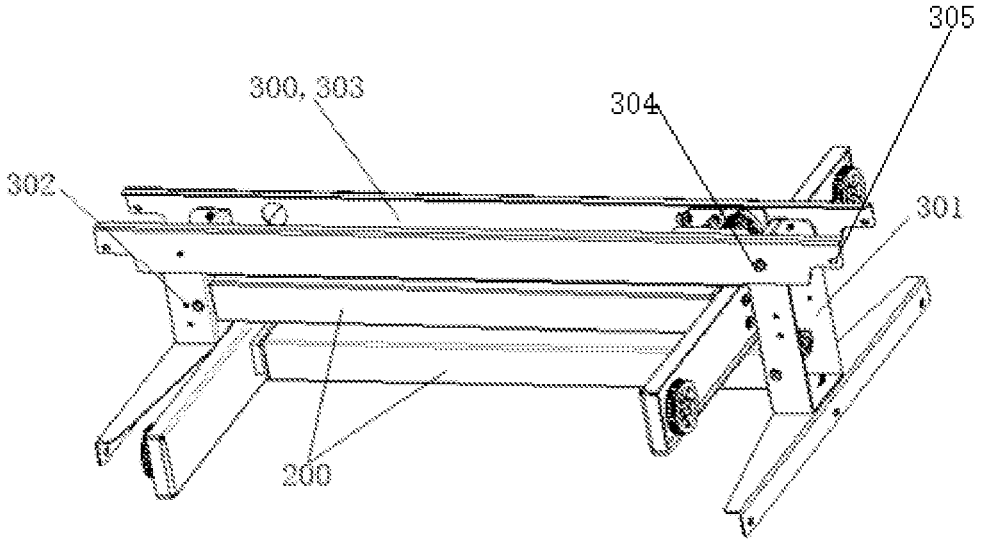
FIG. 8 is a schematic structural diagram of a lifting device of the present invention after folding.
Figure 9:
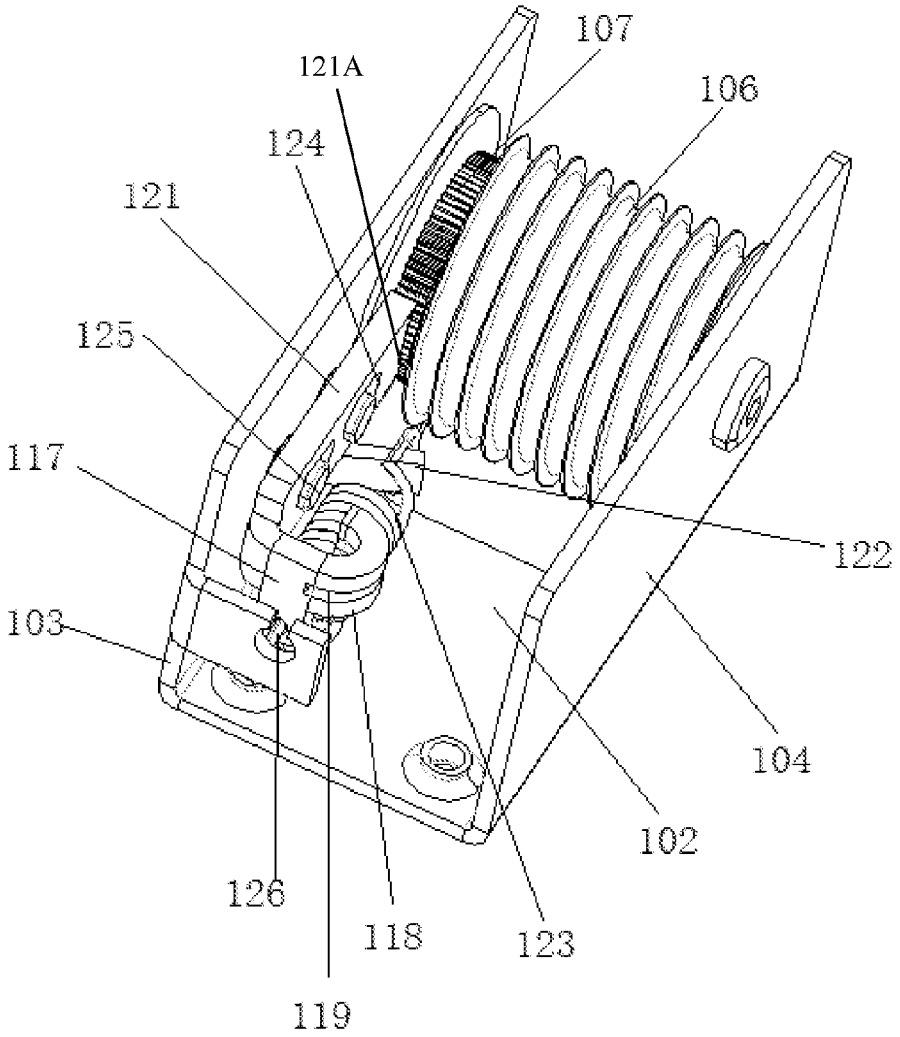
FIG. 9 is a schematic structural diagram of a steel wire self-locking mechanism according to Embodiment 2 of the present invention.
Figure 10:
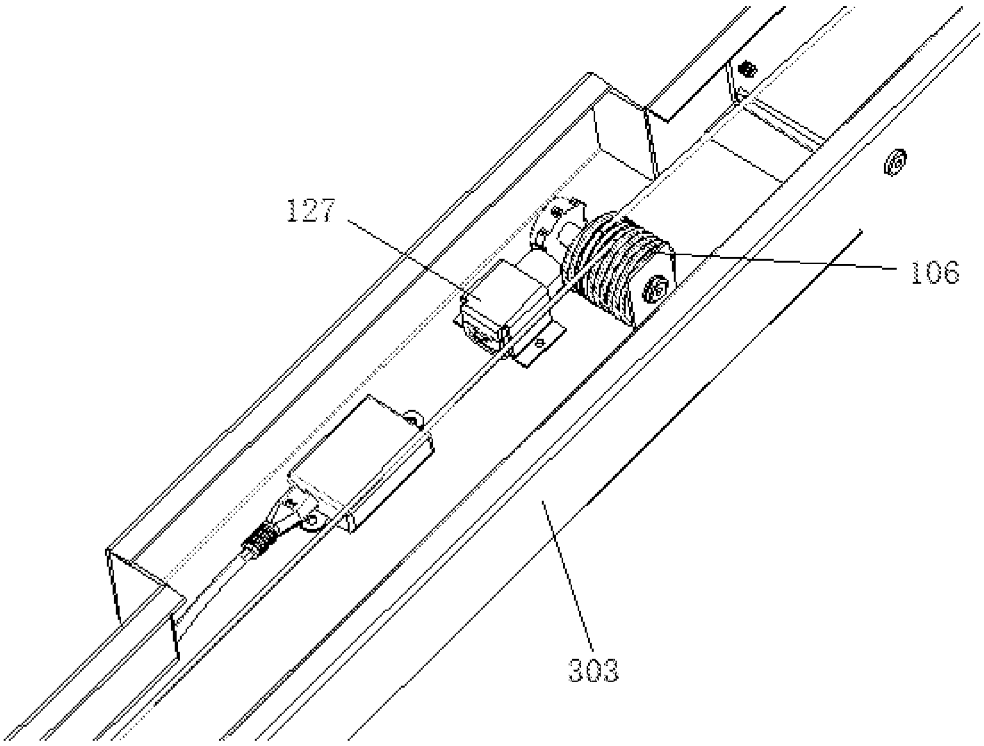
FIG. 10 is a schematic structural diagram according to Embodiment 3 of the present invention.

Referring to FIG. 6, taking one of the lifting assemblies 200 as an example, one end of the first steel cable 401 is firstly wound on the first pulley and the second pulley, that is, at the second pulley 212, the first steel cable 401 forms a U shape, and the tail end at the second pulley is fixed to the second fixing component 215. The second steel cable 402 is wound on the third pulley 213, and makes its tail end fixed to the first fixing component 214. With this arrangement, in the other opposite lifting assembly 200, the other end of the first steel cable 401 should be fixed to the first fixing component 214, and the other end of the second steel cable 402 should be fixed to the second fixing component 215.

In an upward moving process, the gas spring 203 pushes the pin shaft 204 and the U-shaped connecting rod 209 to move together. Since the total length of the first steel cable 401 and the second steel cable 402 remains unchanged, if the first fixing component 214 on one side releases the cable, the second fixing component 215 on the other side retracts the cable immediately. Two sets of steel cables restrain each other to improve the stability in the upward moving process.

In actual production and use processes, the gas spring 203 only needs to be arranged in the inner fixing pipe 202 on one side. Using the structure with two steel cables, on the one hand, reduces the joggling or jamming caused by inconsistent upward moving and downward moving speeds of the gas spring 203 in the upward moving process, and on the other hand, effectively reduces the cost and the overall weight of the lifting device.

The beam assembly 300 includes a first bracket 301 and a second bracket 302 oppositely arranged at the top end of the outer fixing pipe 201. The bottom ends of the first bracket and the second bracket are provided with holes, allowing the lifting end of the gas spring 203 to pass through. A beam frame 303 is arranged between the first bracket and the second bracket. Two ends of the beam frame 303 are respectively provided with a first through hole 304 and at least one second through hole 305. The first through hole 304 is formed on the inner side of the second through hole 305. When folding, the first bracket and the second bracket are rotatably connected with the beam frame 303 by only the first through hole 304. When unfolding, the first bracket and the second bracket are fixedly connected with the beam frame 303 by the first through hole 304 and the second through hole 305, and the bottom of the beam frame 303 is fixedly connected with the bottom plate 102 by self-tapping screws. The length of the first bracket 301 is greater than the length of the second bracket 302 by a width distance of at least one outer fixing pipe 201.

Specifically, the side edges of the holes of the first and second brackets are also integrally formed with support components for carrying the pin shaft 204, thereby sharing the resistance and pressure in the upward moving process.

When the lifting device is not used or the lifting device needs to be transported, the screw in the second through hole 305 is unscrewed, and only the screw in the first through hole 304 is retained for the bracket to rotate, so that the lifting assembly 200 can be retracted and placed. The first bracket 301 is longer than the second bracket 302. If no column feet are arranged, the distance by which the first bracket 301 is longer than the second bracket 302 is equal to the thickness of the outer fixing pipe 201, which just enables the first bracket to be smoothly folded. If the column feet are arranged and the thickness of the column feet is greater than that of the outer fixing pipe 201, the extension length should be equivalent to the thickness of the column feet.

The gas spring 203 includes a cylinder barrel 216 and a piston rod 217. The bottom of the cylinder barrel 216 is provided with a hole capable of accommodating the piston rod 217 to move. The top end of the piston rod 217 is narrowed and is provided with a lug boss. A pressure stabilizing piston 218 is arranged above the lug boss, and the pressure stabilizing piston 218 is provided with a flow hole 219. When the gas spring 203 is in a full relaxation state, the cylinder barrel 216 and the pressure stabilizing piston 218 together enclose a first cavity 220, and the first cavity 220 is filled with lubricating oil 221. The volume of the lubricating oil 221 is determined according to the length of the required buffer distance, and generally occupies at least one tenth of the volume of the first cavity 220.

In the above-mentioned gas spring 203, the first cavity 220 is filled with compressed gas, and the compressed gas is an inert gas. After the pressure is released, since the pressure stabilizing piston 218 is provided with the flow hole 219, the gas pressures at two ends of the pressure stabilizing piston 218 are equal. However, the cross-sectional areas of two sides of the pressure stabilizing piston 218 are different, and the piston rod 217 is connected at one end and not at the other end. Under the action of the gas pressure, the pressure is generated to the side with a smaller cross-sectional area, that is, the elasticity of the gas spring 203 is generated, and the magnitude of the elasticity can be set by setting different nitrogen pressures or piston rods 217 having different diameters.

Since the flow rate of the gas is faster than that of the viscous lubricating oil 221, after the compressed gas flows through the flow hole 219, the lubricating oil 221 starts to flow; this time is the last one-tenth stage of upward moving of the outer support component 216, and the upward moving speed drops abruptly to prevent damage to various components due to inertia after fast upward moving.

Embodiment 2

On the basis of Embodiment 1, the locking device 108 of the self-locking mechanism is modified, and the specific modification manner is as follows:

The locking device 108 includes a second locking plate 121, a convex plate 122 and a tension spring 123. At least two slotted holes 124 are formed in the middle of the second locking plate 121. The first side plate 103 is provided with fixing shafts 125 matched with the slotted holes 124. A tooth part 121A is arranged at one end of the second locking plate 121 close to the self-locking gear 107, and a hook part 118 is arranged at the other end of the second locking plate 121. A hook groove 119 is formed in the hook part 118. A pull block 120 passes through the hook groove 119 and is fixedly connected with a dragline 110. A hole of the tension spring 123 is formed in the bottom of the hook part 118. One end of the convex plate 122 is fixed to the first side plate 103, and the other end of the convex plate protrudes toward the second side plate 104. The end of the convex plate 122 that protrudes is connected with the hole of the tension spring 123 through the tension spring 123.

In the present embodiment, the slotted holes 124 are formed in the second locking plate 121 and are matched with the fixing shafts 125 on the first side plate 103, so that the second locking plate 121 has a space for displacement. The difference from Embodiment 1 is that the present embodiment does not rely on the coiled torsion spring 115 to provide tension, but instead relies on the elasticity of the extended tension spring 123 to force the second locking plate 121 to be unlocked or to lock the self-locking gear 107.

In order to make the assembly more convenient, the slotted holes 124 may also be made into semicircular holes.

Embodiment 3

On the basis of Embodiment 1 and Embodiment 2, the locking device 108 no longer uses a mechanical self-locking mechanism. A motor 127 is used to drive the above-mentioned threaded sleeve 106, and the output end of the motor 127 is fixedly connected with the threaded sleeve 106. A flat hole or a square hole is generally formed in the threaded sleeve 106 so as to adapt to a flat shaft or a square shaft at the output end of the motor. Meanwhile, there is generally a deceleration device, such as a worm gear or a reduction gear, and the deceleration device is controlled by a handle to rotate forward and rotate backward. Since the threaded sleeve 106 is wound with the first steel cable 401, the forward rotation and backward rotation of the threaded sleeve can drive the lifting device to move up and down. The lifting function can also be realized by only using the motor 127 to drive the threaded sleeve 106, but when matched with a gas spring, a motor 127 with a smaller power and a smaller volume can be used, thereby effectively reducing the cost and volume.

In addition, the motor 127 also has a locking function which can maintain the position of the lifting device.

Finally, the handle may be in wired connection with the motor 127 and may also be in wireless connection with the motor 127, so that the use is more convenient.

The foregoing descriptions are merely preferred embodiments of the present invention, but are not intended to limit the present invention. A person skilled in the art may make various alterations and variations to the present invention. Any modification, equivalent replacement, improvement and the like made within the spirit and principle of the present invention shall fall within the protection scope of the present invention.

What is claimed is:

1. A steel wire self-locking mechanism with a surrounding plate, comprising:

a first rotating shaft;

wherein the surrounding plate comprises a bottom plate, a first side plate and a second side plate;

wherein the first side plate and the second side plate are vertically arranged on two edges of the bottom plate;

the first rotating shaft is erected between the first side plate and the second side plate:

a threaded sleeve is arranged outside the first rotating shaft, wherein a steel wire is wound on the threaded sleeve;

the threaded sleeve rotates around the first rotating shaft or the threaded sleeve synchronously rotates with the first rotating shaft;

a self-locking gear rotating with the threaded sleeve is coaxially fixed at one end of the threaded sleeve;

a locking device for locking the self-locking gear is further arranged between the first side plate and the second side plate;

a dragline hole is formed in the first side plate;

a dragline passes through the dragline hole and the dragline drives the locking device to open and close; and the dragline is driven by an external dragline handle.

2. The steel wire self-locking mechanism according to claim 1, wherein the locking device comprises an L-shaped plate fixed to the bottom plate, a fixing shaft is arranged between the L-shaped plate and the first side plate, the fixing shaft is sleeved with a first locking plate and a torsion spring, a tail end of an outer side of the torsion spring is folded toward a direction of the first locking plate and extends, the first locking plate comprises a plate body, a tooth part is arranged on a surface of a tail end of the plate body, wherein the surface of the tail end of the plate body is attached to the self-locking gear, a pull plate is arranged at a middle part of the plate body, a hook part is arranged at an upper end of the pull plate, a hook groove is formed in the hook part, and a pull block passes through the hook groove and the pull block is fixedly connected with the dragline.

3. The steel wire self-locking mechanism according to claim 1, wherein the locking device comprises a second locking plate, a convex plate and a tension spring, wherein at least two slotted holes are formed in a middle of the second locking plate, fixing shafts matched with the at least two slotted holes are arranged on the first side plate, a first end of the second locking plate is provided with a tooth part, wherein the first end of the second locking plate is adjacent to the self-locking gear, a second end of the second locking plate is provided with a hook part, a hook groove is formed in the hook part, a pull block passes through the hook groove and the pull block is fixedly connected with the dragline, a tension spring hole is formed in a bottom of the hook part, a first end of the convex plate is fixed to the first side plate, a second end of the convex plate protrudes toward a direction of the second side plate, and the second end of the convex plate is connected with the tension spring hole through the tension spring.

4. The steel wire self-locking mechanism according to claim 1, wherein a motor is arranged at one end of the threaded sleeve, an output end of the motor is fixedly connected with an end of the threaded sleeve, the motor is powered by an external power supply, and the motor is controlled by an external control handle to rotate forward, rotate backward and stop.

5. A lifting device with a steel wire self-locking mechanism, comprising the steel wire self-locking mechanism according to claim 1, and a first and second lifting assembly, wherein the first and second lifting assemblies are arranged in a manner of central symmetry, a beam assembly is erected between the first and second lifting assemblies, a first steel cable and a second steel cable parallel to each other are arranged between the first and second lifting assemblies; the first steel cable comprising: a middle part wound on the threaded sleeve, and a first part and a second part, wherein the first part and the second part are on opposing sides of the middle part, and wherein the first part and the second part are located on one horizontal line when the middle part of the first steel cable is wound on the threaded sleeve, each of the first and second lifting assemblies comprises: an outer fixing pipe and an inner fixing pipe, a gas spring is arranged in the inner fixing pipe, a top end of the outer fixing pipe is fixedly connected with a bottom end of the beam assembly, a lifting end of the gas spring is connected with a pin shaft, and the pin shaft radially passes through the beam assembly and the pin shaft is fixed with the beam assembly.

6. The lifting device according to claim 5, wherein a U-shaped connecting rod is further arranged in the inner fixing pipe, the U-shaped connecting rod comprises a connecting rod body, an upper section and a lower section of the connecting rod body are respectively provided with a first pulley and a second pulley, the first pulley sleeves the pin shaft, the pin shaft is sleeved with a third pulley, and the first pulley and the third pulley are respectively arranged at two sides of the gas spring; a first fixing component is arranged on a first side wall of the inner fixing pipe, and a second fixing component is arranged on a second side wall of the inner fixing pipe; and a first end of the first steel cable is wound on the first pulley and the second pulley on a first side of the gas spring, and the first end of the first steel cable is fixed to the second fixing component, a second end of the first steel cable is wound on the third pulley on a second side of the gas spring, and the second end of the first steel cable is fixed to the first fixing component, and two ends of the second steel cable are arranged in the same manner as the two ends of the first steel cable in opposite directions.

7. The lifting device according to claim 5, wherein the beam assembly comprises a first bracket and a second bracket oppositely arranged at the top end of the outer fixing pipe, bottom ends of the first bracket and the second bracket are provided with holes, wherein the lifting end of the gas spring passes through the holes, a beam frame is arranged between the first bracket and the second bracket, each of two ends of the beam frame is provided with a first through hole and at least one second through hole, the first through hole is formed in an inner side of the at least one second through hole;

when folding, the first bracket and the second bracket are rotatably connected with the beam frame only by the first through hole;

when unfolding, the first bracket and the second bracket are fixedly connected with the beam frame by the first through hole and the at least one second through hole; and the beam frame is fixedly connected with the bottom plate.

8. The lifting device according to claim 7, wherein a length of the first bracket is greater than a length of the second bracket by a width distance of at least one outer fixing pipe.

9. The lifting device according to claim 5, wherein the locking device comprises an L-shaped plate fixed to the bottom plate, a fixing shaft is arranged between the L-shaped plate and the first side plate, the fixing shaft is sleeved with a first locking plate and a torsion spring, a tail end of an outer side of the torsion spring is folded toward a direction of the first locking plate and extends, the first locking plate comprises a plate body, a tooth part is arranged on a surface of a tail end of the plate body, wherein the surface of the tail end of the plate body is attached to the self-locking gear, a pull plate is arranged at a middle part of the plate body, a hook part is arranged at an upper end of the pull plate, a hook groove is formed in the hook part, and a pull block passes through the hook groove and the pull block is fixedly connected with the dragline.

10. The lifting device according to claim 9, wherein a U-shaped connecting rod is further arranged in the inner fixing pipe, the U-shaped connecting rod comprises a connecting rod body, an upper section and a lower section of the connecting rod body are respectively provided with a first pulley and a second pulley, the first pulley sleeves the pin shaft, the pin shaft is sleeved with a third pulley, and the first pulley and the third pulley are respectively arranged at two sides of the gas spring; a first fixing component is arranged on a first side wall of the inner fixing pipe, and a second fixing component is arranged on a second side wall of the inner fixing pipe; and a first end of the first steel cable is wound on the first pulley and the second pulley on a first side of the gas spring, and the first end of the first steel cable is fixed to the second fixing component, a second end of the first steel cable is wound on the third pulley on a second side of the gas spring, and the second end of the first steel cable is fixed to the first fixing component, and two ends of the second steel cable are arranged in the same manner as the two ends of the first steel cable in opposite directions.

11. The lifting device according to claim 9, wherein the beam assembly comprises a first bracket and a second bracket oppositely arranged at the top end of the outer fixing pipe, the first bracket and the second bracket are provided with holes, wherein the lifting ends of the gas springs of the first and second lifting assemblies passes through the holes the first and second brackets, a beam frame is arranged between the first bracket and the second bracket, the beam frame comprises cach of two ends, each of said two ends provided with a first through hole and at least one second through hole, the at least one second through hole is formed closer to said end of the beam frame than the first through hole; when folding, the first bracket and the second bracket are rotatably connected with the beam frame only by the first through holes; when unfolding, the first bracket and the second bracket are fixedly connected with the beam frame by the first through holes and the at least one second through holes; and the beam frame is fixedly connected with the bottom plate.

12. The lifting device according to claim 11, wherein a length of the first bracket is greater than a length of the second bracket by a width distance of at least one outer fixing pipe.

13. The lifting device according to claim 5, wherein the locking device comprises a second locking plate, a convex plate and a tension spring, wherein at least two slotted holes are formed in a middle of the second locking plate, fixing shafts matched with the at least two slotted holes are arranged on the first side plate, a first end of the second locking plate is provided with a tooth part, wherein the first end of the second locking plate is adjacent to the self-locking gear, a second end of the second locking plate is provided with a hook part, a hook groove is formed in the hook part, a pull block passes through the hook groove and the pull block is fixedly connected with the dragline, a tension spring hole is formed in a bottom of the hook part, a first end of the convex plate is fixed to the first side plate, a second end of the convex plate protrudes toward a direction of the second side plate, and the second end of the convex plate is connected with the tension spring hole through the tension spring.

14. The lifting device according to claim 13, wherein a U-shaped connecting rod is further arranged in the inner fixing pipe, the U-shaped connecting rod comprises a connecting rod body, an upper section and a lower section of the connecting rod body are respectively provided with a first pulley and a second pulley, the first pulley sleeves the pin shaft, the pin shaft is sleeved with a third pulley, and the first pulley and the third pulley are respectively arranged at two sides of the gas spring; a first fixing component is arranged on a first side wall of the inner fixing pipe, and a second fixing component is arranged on a second side wall of the inner fixing pipe; and a first end of the first steel cable is wound on the first pulley and the second pulley on a first side of the gas spring, and the first end of the first steel cable is fixed to the second fixing component, a second end of the first steel cable is wound on the third pulley on a second side of the gas spring, and the second end of the first steel cable is fixed to the first fixing component, and two ends of the second steel cable are arranged in the same manner as the two ends of the first steel cable in opposite directions.

15. The lifting device according to claim 13, wherein the beam assembly comprises a first bracket and a second bracket oppositely arranged at the top end of the outer fixing pipe, the first bracket and the second bracket are provided with holes, wherein the lifting ends of the gas springs of the first and second lifting assemblies passes through the holes the first and second brackets, a beam frame is arranged between the first bracket and the second bracket, the beam frame comprises two ends, each of said two ends provided with a first through hole and at least one second through hole, the at least one second through hole is formed closer to said end of the beam frame than the first through hole; when folding, the first bracket and the second bracket are rotatably connected with the beam frame only by the first through holes; when unfolding, the first bracket and the second bracket are fixedly connected with the beam frame by the first through holes and the at least one second through holes; and the beam frame is fixedly connected with the bottom plate.

16. The lifting device according to claim 5, wherein a U-shaped connecting rod is further arranged in the inner fixing pipe, the U-shaped connecting rod comprises a connecting rod body, an upper section and a lower section of the connecting rod body are respectively provided with a first pulley and a second pulley, the first pulley sleeves the pin shaft, the pin shaft is sleeved with a third pulley, and the first pulley and the third pulley are respectively arranged at two sides of the gas spring; a first fixing component is arranged on a first side wall of the inner fixing pipe, and a second fixing component is arranged on a second side wall of the inner fixing pipe; and a first end of the first steel cable is wound on the first pulley and the second pulley on a first side of the gas spring, and the first end of the first steel cable is fixed to the second fixing component, a second end of the first steel cable is wound on the third pulley on a second side of the gas spring, and the second end of the first steel cable is fixed to the first fixing component, and two ends of the second steel cable are arranged in the same manner as the two ends of the first steel cable in opposite directions.

17. The lifting device according to claim 5, wherein the beam assembly comprises a first bracket and a second bracket oppositely arranged at the top end of the outer fixing pipe, the first bracket and the second bracket are provided with holes, wherein the lifting ends of the gas springs of the first and second lifting assemblies passes through the holes the first and second brackets, a beam frame is arranged between the first bracket and the second bracket, the beam frame comprises two ends, each of said two ends provided with a first through hole and at least one second through hole, the at least one second through hole is formed closer to said end of the beam frame than the first through hole; when folding, the first bracket and the second bracket are rotatably connected with the beam frame only by the first through holes; when unfolding, the first bracket and the second bracket are fixedly connected with the beam frame by the first through holes and the at least one second through holes; and the beam frame is fixedly connected with the bottom plate.

18. The lifting device according to claim 17, wherein a length of the first bracket is greater than a length of the second bracket by a width distance of at least one outer fixing pipe.

* * * * *